United States Patent [19]

Heilenz

[11] Patent Number: 4,988,046

[45] Date of Patent: Jan. 29, 1991

[54] PULVERIZER WITH AIR FILTERING MEANS

[76] Inventor: Siegfried Heilenz, Sportfeld 7, D-6300 Giessen-Kleinlinden, Fed. Rep. of Germany

[21] Appl. No.: 328,867

[22] Filed: Mar. 27, 1989

[30] Foreign Application Priority Data

Mar. 25, 1988 [DE] Fed. Rep. of Germany ... 8804036[U]

[51] Int. Cl.[5] ..... B02C 23/20

[52] U.S. Cl. ..... 241/60; 241/100; 241/285 A

[58] Field of Search ..... 241/37.5, 49, 57, 58, 241/60, 100, 285 R, 285 A, 285 B, DIG. 14

[56] References Cited

U.S. PATENT DOCUMENTS 4,754,933 7/1988 Lenthold et al. ..... 241/236 X

*Primary Examiner*—Timothy V. Eley

*Attorney, Agent, or Firm*—Flynn, Thiel, Boutell & Tanis

[57] ABSTRACT

Pulverizers, which are driven by motors and have an inlet chute and a pulverizing device connected to a collecting reservoir for minimizing of the created amount of dust are, in order to assure with a simple and safe design and easy operation, constructed such that the pulverizer (1) is arranged in a housing (6), which has an air-inlet opening (22) and an air outlet (8). The air outlet (8) is arranged on the bottom side of the housing (6) and is connected to a vacuum source. A filter (9) is provided in the area of the air outlet (8), which can be connected to an air source loading the filter 9) with compressed air in counter-flow direction.

12 Claims, 4 Drawing Sheets

12
17
18
1
3
2
16
11
19
20
21
6
5
4
24
26
30
29

PULVERIZER WITH AIR FILTERING MEANS

FIELD OF THE INVENTION

The invention relates to a pulverizer comprising a pulverizing device driven by means of a motor and connected to an inlet chute and a collecting reservoir.

BACKGROUND OF THE INVENTION

Pulverizers of the above-mentioned type are used in particular in laboratories in order to pulverize samples, which are subsequently subjected to a chemical analysis. It has thereby been proven to be necessary to proceed particularly carefully during a pulverizing of the respective substances since the preparation of the sample substance decisively influences the results of the analysis. When using the most modern analysis methods, it is possible to significantly reduce the amount of the necessary material. This results in shorter sample preparation times and in a considerable savings of material. In the case of very small sample volumes, the demands on the crushing task, namely the pulverizing of the samples, increases considerably since the substances to be analyzed must be separated very finely and this has proven to be disadvantageous. The necessary grain sizes are thereby in most cases less than 0.1 mm. Since furthermore the substances to be pulverized are usually predried, a considerable dust formation occurs caused by the fine pulverization and by the predrying of the substances.

This dust formation demands, in particular in the case of health-hazardous substances, that the operators wear breathing or dust masks, which always prove to be uncomfortable and very hampering. It is furthermore necessary to thoroughly ventilate the respective work space in order to prevent it from becoming dirty because a dirty pulverizing space can result in adulteration of pulverized samples.

For environmental reasons, it is not possible to blow the pulverization dust into the surrounding environment. The system of taking dust out of a work space always requires many apparatus and is therefore very expensive. In addition, these apparatus operate with a high level of noise, also the danger of sample losses exists.

The basic purpose of the invention is to provide a pulverizer of the above-mentioned type, which minimizes the nascent amount of dust, has a simple design and is safe and easy to operate.

The purpose is inventively attained by arranging the pulverizer in a housing having at least one air-inlet opening and one air outlet, by the air outlet being arranged on the bottom side on the housing and being connected to a vacuum source and by providing a filter in the area of the air outlet, which filter can be connected to an air source loading the filter with compressed air in counter-flow direction.

The inventive pulverizer has a number of significant advantages. The arrangement in the housing makes it possible to catch the dust, exiting between the individual structural parts of the pulverizer due to leaks, in a safer method. Furthermore, it is possible to open the pulverizer inside of the housing, for example, to clean the pulverizing device. By connecting the air outlet to a vacuum source, it is assured that a sufficient air flow through the housing exists at all times guiding the dust particles in a safe manner to the filter of the air outlet where these at least partially are caught and are filtered out. The filter in the area of the air outlet is provided in order to prevent an excessive dust load on the vacuum source. The possibility of connecting the filter to an air source loading the filter with compressed air in counter-flow direction facilitates a regeneration of the filter, with the dust particles accumulated on the filter dropping back onto the bottom of the housing, accumulating there and at some time being removed manually with a shovel or by means of a vacuum cleaner.

Thus the inventive pulverizer assures that dust cannot exit into the work space during the pulverizing operation. Thus, it is possible to use the pulverizer in the usual laboratory spaces, whereas in the case of the state of the art, it was necessary to operate the pulverizer, because of the strong dust formation, in a separate room.

The inventive regeneration of the filter by means of counter-flowing compressed air must be carried out no earlier than after five, in most cases only after 10 or more pulverizing operations. It guarantees a uniformly high intensity of vacuuming the dust from the housing and enhances the life of the vacuum source, since the there existing dust collector is not directly observable. The dust collector already becomes through this ineffective, according to experience, after a short period of operation due to it being overfilled, which leads to a loss of the vacuum source and thus the vacuuming task.

Since air flows always through the housing of the inventive pulverizer, the danger of a dust explosion is avoided. It is furthermore possible to effectively dampen the noise development coming from the pulverizer through the housing. Furthermore, the occurring material loss is reduced to a minimum, since during the subsequent removal of the collecting reservoir an air flow for the purpose of ventilation does not need to exist in the work space.

The inventive pulverizer is constructed preferably so that the dust-filled air in the housing is exchanged at least one time per second with fresh air.

An advantageous further development of the inventive pulverizer exists by the vacuum source being constructed in the form of a vacuum mechanism provided with a dust collector. The vacuum mechanism can thereby be designed in the form of a commercially available vacuum cleaner. Since a separate, regenerable filter is provided in the area of the air outlet on the housing, it is assured that only a small amount of dust moves into the vacuum mechanism so that its dust collector need be cleaned at longer time intervals, for example once a year.

The air-inlet opening for producing an air flow directed toward the bottom of the housing is preferably arranged in the upper area of the housing. This development assures that the dust particles are fed to the bottom area and are deposited partly already directly on the bottom without reaching the filter of the air outlet.

To clean the inside of the housing, same is provided advantageously with a closeable, slot-shaped opening for introducing a compressed-air lance. It is possible by means of the compressed-air lance to blow off the pulverizing device of the pulverizer after the pulverizing device was opened and also the inner walls of the housing and to clean off adhering dust and residues of crushed material. The vacuum source sucks in the material loosened during this cleaning and feeds it to the filter of the air outlet. The compressed-air lance can thereby be constructed advantageously such that it, in connection with a suitable arrangement of the opening of the housing, is not possible to guide the compressed-air lance into the pulverizing device of the pulverizer. It is thus avoided that after turning off the motor of the pulverizer the rotor which continues to run yet for a longer period of time can be touched by the lance. Thus it cannot be damaged and the operators are not endangered. The possibility to be able to start already with the cleaning task during a still running rotor does not only considerably shorten the operation, but also increases the cleaning effect.

A particularly advantageous development of the inventive pulverizer exists in the housing, including devices for opening of the pulverizer and for removing the collecting reservoir, which devices can be operated from outside of the housing. This development significantly accelerates the cleaning operation of the pulverizer, since it is not necessary to first wait for a complete vacuuming off of the dust on the inside and for the standstill of the pulverizing device.

For opening of the pulverizing device, the inlet chute together with a lid portion is in known pulverizers usually swung out. In order to prevent dust from exiting from the opening associated with the inlet chute and in order to prevent more air from being able to flow into the housing than is sucked off by the vacuum source, the opening is at least partly covered by means of a perforated plate. The perforated plate is constructed such that only a specific amount of air can be sucked into the housing.

A further advantageous development of the pulverizer exists by the collecting reservoir being open through a filter to the inside of the housing.

This filter has the effect that the low vacuum on the inside of the housing continues into the collecting reservoir. The air flow balancing the vacuum enters the pulverizer at the inlet chute and moves through the inside of the pulverizer—carrying with it the here created pulverization dust—into the collecting reservoir. The narrow filter pores hardly permit crushed material to pass. Thus an accumulation of dust inside of the pulverizer, which accumulation could in the case of a very dusty pulverization (for example of earth) result in a loss of dust through the inlet chute into the surrounding environment, is avoided.

It furthermore has proven to be advantageous to arrange the motor outside of the housing. A sufficient cooling of the motor is in this manner assured, on the other hand its contamination with pulverization dust is prevented.

Furthermore it has proven to be advantageous that the housing has air-inlet openings in the area of its corners and edges. Since a defined air flow can always enter through the air-inlet openings, it is prevented that larger amounts of dust settle in the corners or edges.

A cleaning of the filter of the air outlet is done preferably by means of a water-jet pipe arranged movably on the housing in an outlet chamber. The water-jet pipe can be loaded with pressure. Since the water-jet pipe is movable, it is possible to load the filter selectively with air in order to remove dust particles adhering over its entire cross-sectional surface.

BRIEF DESCRIPTION OF THE DRAWINGS

The invention will be discussed hereinafter in connection with the drawings, in which.

DETAILED DESCRIPTION

Figure 1:
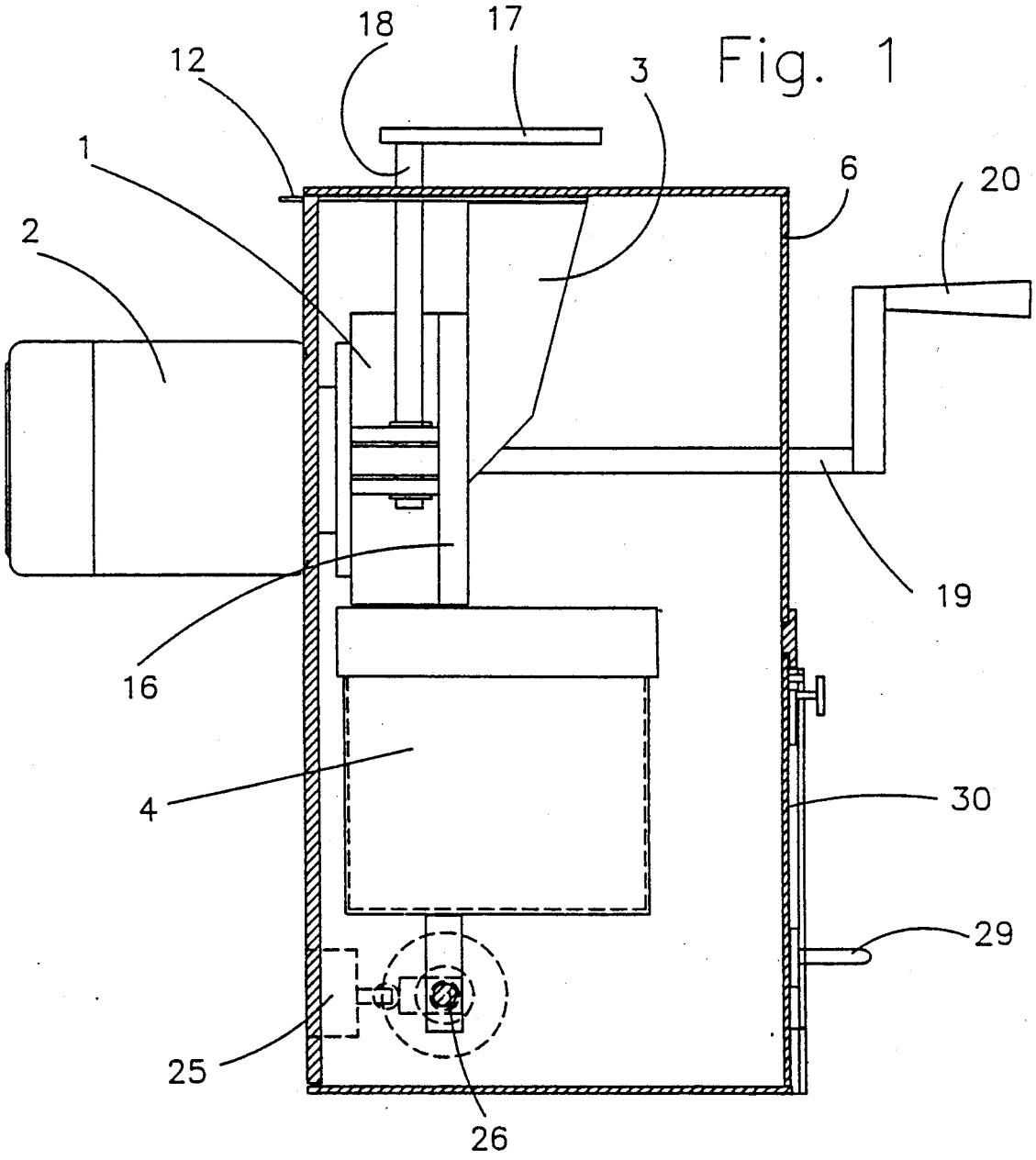
FIG. 1 is a partially cross-sectioned schematic side view of the inventive pulverizer.

FIG. 1 is a side view of an exemplary embodiment of an inventive pulverizer 1 arranged in a housing 6 and has a motor 2 supported outside of the housing 6. The pulverizer 1 has an inlet chute 3 through which material to be crushed is fed to a pulverizing device 5 not illustrated in FIG. 1. The pulverizing device 5 includes usually a beater drivable by the motor 2 and an inner wall having projections or grooves. After the crushing in the pulverizing device 5, the pulverized material moves into a collecting reservoir 4, which can be separated from the pulverizer in order to remove its content.

In order to clean the pulverizing device 5, the lid or cover 16, on which is provided the inlet chute 3, is swung away from the housing of the pulverizer. The lid 16 has an opening, not illustrated, at its upper area, which opening is associated with the inlet chute 3 in its operating position in order to introduce material to be crushed into the pulverizer 1. Upon a swinging out of the lid 16 and of the inlet chute 3, a relatively large, free opening would now exist in the housing. In order to prevent this, a perforated plate 12 is arranged at the upper area of the housing 6, which plate 12 at least partly covers the opening of the housing.

A rocking lever 17 is used for moving the lid 16 and the inlet chute 3, which rocking lever is connected to a shaft 18, the longitudinal axis of which is simultaneously the pivot axis of the lid 16. The rocking lever 17 is arranged outside of the housing 6, so that the lid 16 can be opened without the operator having to open the housing 6. In order to hold the lid 16 in its closed position, a rod 19 is provided, the front end of which rod is threaded and can be guided through a recess of the lid and can be screwed to the housing and/or the pulverizer. To facilitate this screwing operation, a crank 20 is used, which crank is arranged outside of the housing 6 and is connected to the threaded rod 19. The threaded rod 19 can be moved in its longitudinal direction so that same can be removed from the housing 6 after its release and can at least partly be pulled out to permit opening of the lid 16.

Figure 2:
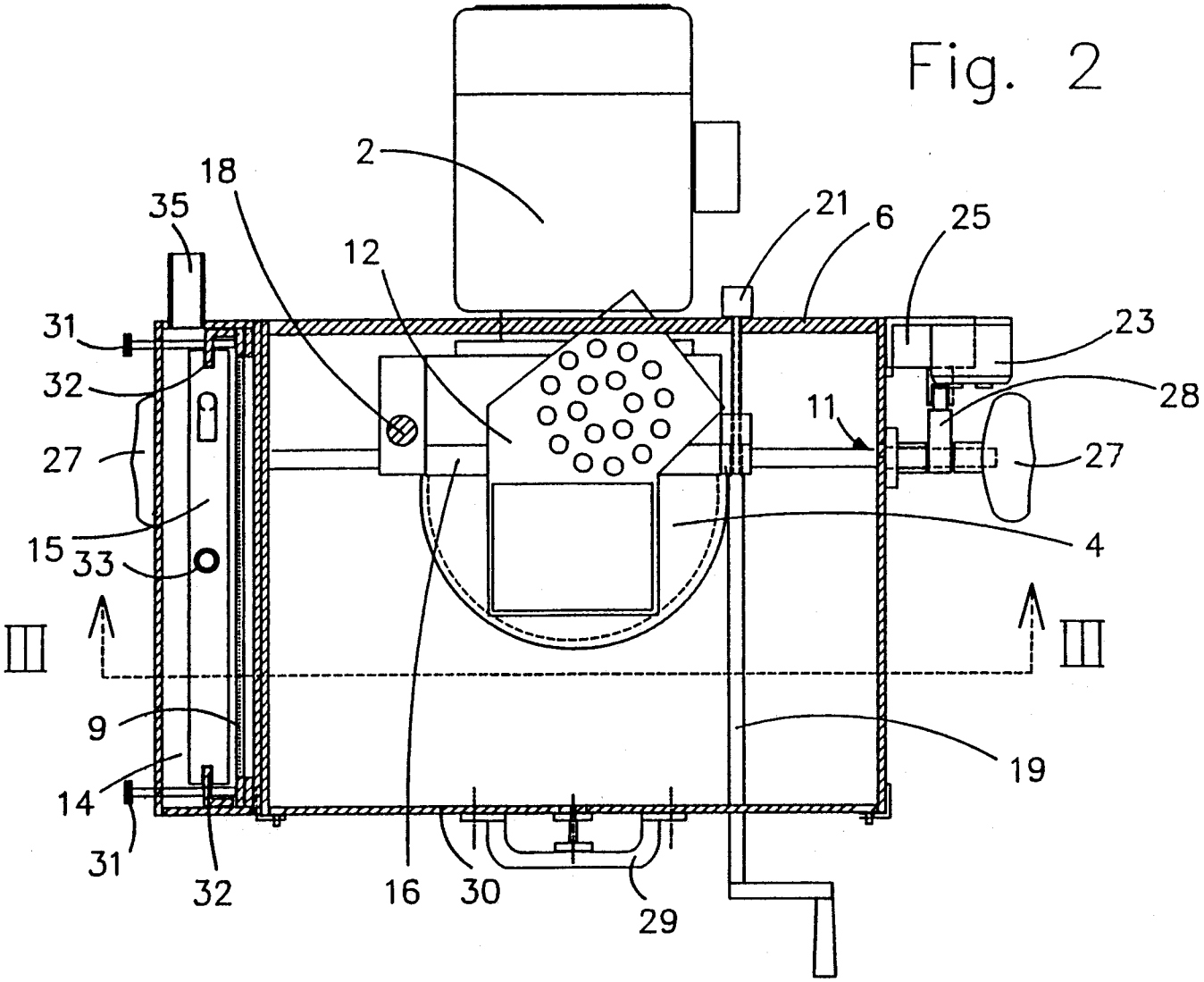
FIG. 2 is a partially cross-sectioned top view of the pulverizer of FIG. 1.

FIG. 2 shows a top view of the arrangement illustrated in FIG. 1 with the housing 6 being illustrated in cross section. A limit switch 21 is provided in the vicinity of the motor 2 on the housing 6. The limit switch 21 will be operated when the threaded rod 19 is completely screwed in. The limit switch 21 serves as a safety switch and prevents the motor 2 from starting as long as the lid 16 is not closed. FIG. 2 furthermore shows the perforated plate 12, which at least partially can close off the opening of the inlet chute 3 in the housing 6, when the lid 16 is open.

Figure 3:
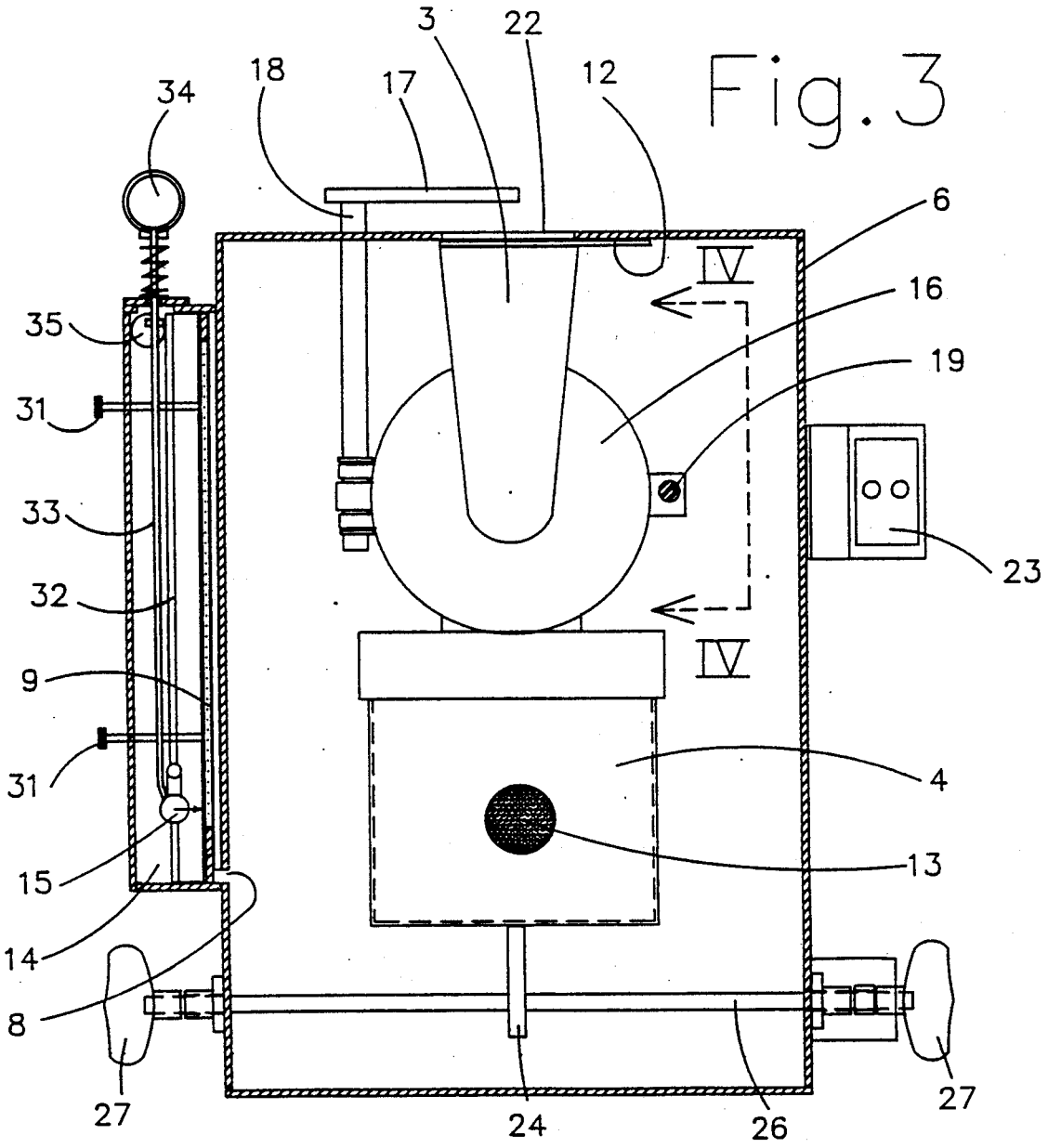
FIG. 3 is a side view taken along the line III—III of FIG. 2.

FIG. 3 shows a cross-sectional view taken along the line III—III of FIG. 2. The opening 22 of the housing 6, which opening is associated with the inlet chute 3, is particularly clearly visible in FIG. 3 just like the perforated plate 12. A main switch 23 is furthermore provided outside of the housing 6. It can turn the motor 2 on and off.

In order to press the collecting reservoir 4 against the housing of the pulverizer 1, an eccentric 24 is provided at the bottom area of the pulverizer. The eccentric 24 is secured on a shaft 26 supported in the housing 6 and extending through its walls. A control knob 27 is provided at each end of the shaft 26. The shaft 26 and thus also the eccentric 24 can be rotated by means of the control knob 27 in order to lift and to lower the collecting reservoir 4. A lever 28, as is shown in FIG. 2, is secured on the shaft 26, which lever can cooperate with a limit switch 25 secured on the housing 6 in order to assure that the motor 2 is started only when the collecting reservoir 4 is orderly connected to the pulverizer 1.

As is illustrated in FIGS. 1 and 2, the lower area of the housing 6 has a front plate 30 connected to a handle 29 and can be opened to remove the collecting reservoir 4.

The collecting reservoir 4 has, as shown in FIG. 3, an opening, which is covered by a filter 13. The filter 13 can be designed in the form of a narrow-mesh net or perforated sheet, which hardly permits the exiting of the finest dust particles from the collecting reservoir.

The housing is furthermore provided with an air outlet 8 arranged in the bottom area (see FIG. 3) and used for the outflow of air from the inside of the housing 6. The air flows thereby through a filter 9 into an outlet chamber 14, which in a not illustrated manner is connected to a vacuum source, for example a vacuum cleaner. The air outlet 8 is constructed slot-shaped to permit a quiet, undisturbed entry of the air into the outlet chamber 14. The filter 9 is held on the housing 6 by means of screws 31. A water-jet pipe 15 is arranged in the outlet chamber 14, which pipe can be moved in vertical direction along a rail 32 and is connected to an air channel 34 through a pipeline 33. Compressed air is supplied through the air channel 34 in order to flow in counter-flow direction through the filter 9. The mobility of the water-jet pipe 15 makes it possible to clean dust particles off from the entire surface of the filter 9. The thus blown-off dust particles fall through the air outlet 8 into the bottom area of the housing 6 and can there be manually removed when the front plate 30 is open.

The outlet chamber 14 has preferably a vacuum outlet 35 at its upper area to assure an even flow through the outlet chamber 14.

Figure 4:
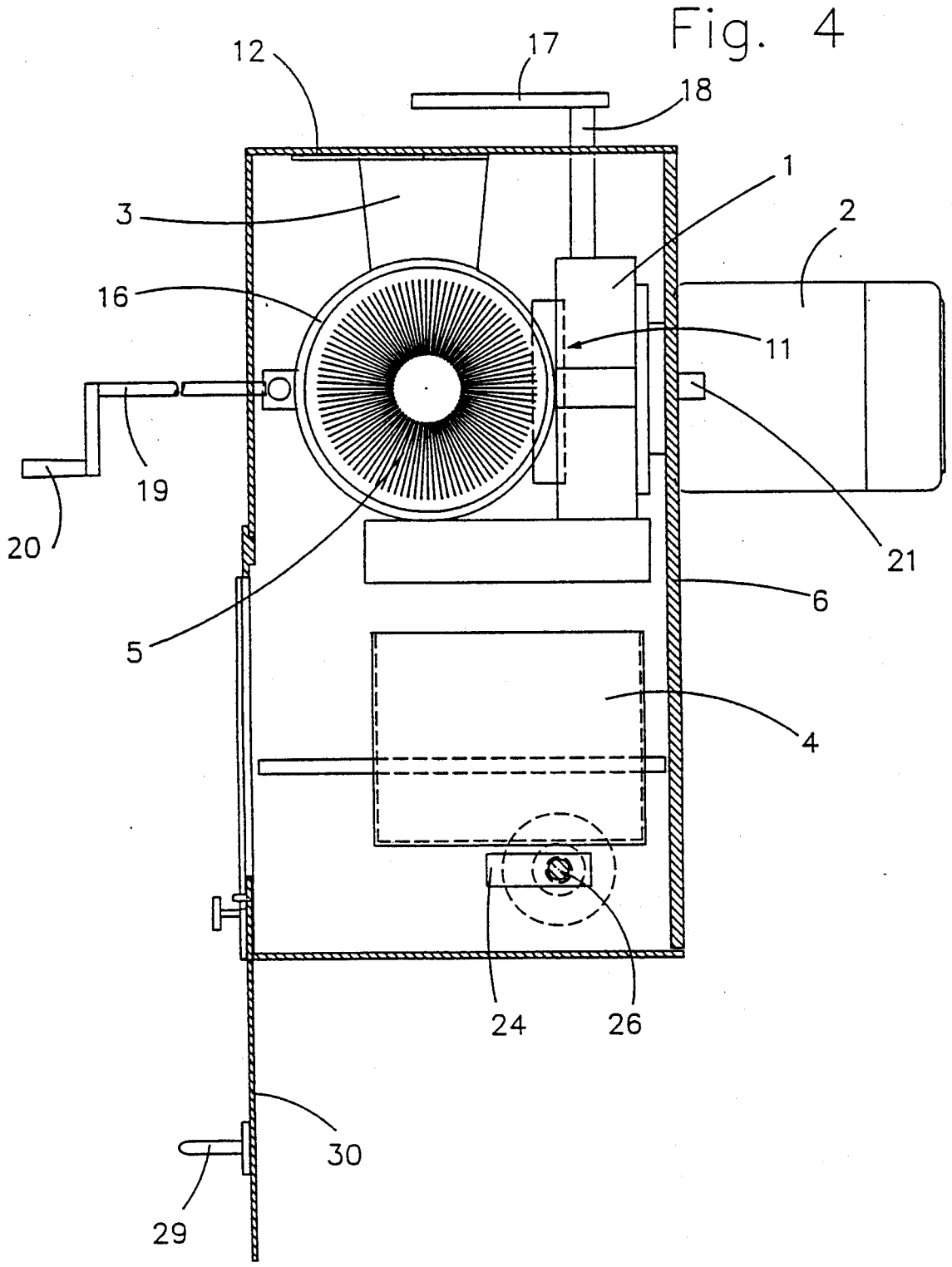
FIG. 4 is a cross-sectional view taken along the line IV—IV of FIG. 3.

FIG. 4 illustrates a view taken along the line IV—IV of FIG. 3, namely a side view of the side of the pulverizer illustrated on the right in FIG. 3. FIG. 4 shows the pulverizer 1 in an open state with the lid 16 being swung out after the threaded rod 19 had been unscrewed to provide access to the interior of the pulverized device 5. A portion of the pulverizing device 5, namely the grooves or tooth system of the lid 16, can be seen on the inside of the lid 16. Furthermore, the collecting reservoir 4 was lowered by turning the shaft 26, namely by pivoting the eccentric 24, so that the collecting reservoir 4 can be removed from the housing 6. The front plate 30 was moved downwardly for this purpose.

The filter 13 of the collecting reservoir 4 has preferably a mesh width of 10 μm and is arranged in a bore with a diameter of 50 mm. The filter 13 also causes a small vacuum in the collecting reservoir 4, which vacuum prevents dust from exiting through the inlet chute 3 and the opening 22 of the housing 6 when the pulverizer is in operation.

The perforated plate 12 is dimensioned such, with respect to the cross sections of its openings, that sufficient air can flow into the inside of the housing 6, on the other hand the open cross sections of the perforated sheet 12 prevent that too much air flows in, which air would no longer be able to be sucked off by the vacuum source, which could then cause dust to exit from the housing 6.

As can be seen in FIG. 2, the housing 6 has a slot-shaped opening 11, through which a compressed-air lance can be guided into the inside of the housing 6 in order to remove dust from and clean the pulverizing device 5 of the pulverizer 1 with the lid 16 open. The compressed-air lance has for this purpose for example lateral bores of 2 mm in diameter and is connected to a pressure source of 7 bar in order to blow for example an amount of air of 25 liter per second into the housing 6. The amount of the air blown in must be less than the amount of air sucked off by the vacuum source. A further effect of this cleaning is a cooling of the pulverizing device 5 of the pulverizer 1.

The design of the outlet chamber 14, of the air outlet 8 and of the filter 9 effects that the air loaded with fine dust first moves with a relatively high speed of flow through the air outlet 8 and thereafter slows down to approximately 1/20th of the speed to permit a settling of the dust particles on the filter 9. The filter 9 is constructed for example in the form of a steel mesh with a 25 μm mesh width and is cleaned by means of the water-jet pipe after five to ten pulverization operations. The vacuum source continues to be connected to the housing 6 during the cleaning operation, however, the amount of air blown in through the water-jet pipe 15 is dimensioned such that counter-flow through filter 9 can still take place. An opening exists for this purpose in the upper area of the outlet chamber 14, which opening is opened by lifting the water-jet pipe and causes the vacuum source to suck in at least partly outside air.

The housing has an inside volume of for example 50 liters so that a commercially available vacuum cleaner can be used as the vacuum source. Since the fine dust is held back at the filter 9, an overload or increased accumulation of dirt on the vacuum cleaner is prevented. Moreover, the vacuuming is advantageously measured such that an air exchange in the housing 6 occurs at least one time per second.

The air outlet 8 has in the illustrated exemplary embodiment a cross-sectional surface of approximately 20 $cm^2$, while the filter 9 has a surface of approximately 400 $cm^2$.

Thus it is possible by means of the inventive pulverizer to prevent, both during the pulverization operation and also during the cleaning operation, dust from exiting into the work space.

The embodiments of the invention in which an exclusive property or privilege is claimed are defined as follows:

1. A pulverizer comprising a pulverizing device driven by means of a motor and connected to an inlet chute and a collecting reservoir for respectively supplying feed material to and receiving pulverized material from said pulverizing device, the improvement wherein the pulverizing device is arranged in a housing having at least one air-inlet opening and an air outlet, said housing otherwise defining a closed space around said pulverizing device, wherein the air outlet is arranged at the bottom side on the housing and is connected to a vacuum source for drawing air in a first direction from said housing through said air outlet, wherein a filter is provided in the area of the air outlet for filtering pulverized material from the air as drawn through said air outlet, and wherein said pulverizing device includes an interior pulverizing means and removable cover means for selectively preventing and permitting access to said interior pulverizing means when said pulverizing device is operating and idle, respectively.

2. The pulverizer according to claim 1, wherein the vacuum source is constructed in the form of a vacuum mechanism provided with a dust collector.

3. The pulverizer according to claim 1, wherein the air-inlet opening, for producing an air flow directed toward the bottom of the housing, is arranged in the upper housing area.

4. The pulverizer according to claim 1, wherein the housing is provided with a closeable, slot-shaped opening for introducing a compressed-air lance for the internal cleaning of the housing.

5. The pulverizer according to claim 1, wherein the housing includes means operable from outside of said housing for removing said cover means and exposing said interior pulverizing means, and further means operable from outside of said housing for selectively disconnecting the collecting reservoir from said pulverizing device.

6. The pulverizer according to claim 1, wherein the air inlet opening of the housing covered at least partly by a perforated plate.

7. The pulverizer according to claim 1, wherein the collecting reservoir is open toward the inside of the housing through a filter.

8. The pulverizer according to claim 1, wherein the motor is arranged outside of the housing.

9. The pulverizer according to claim 1, wherein said vacuum source includes means for displacing the amount of air contained in said housing at least one time per second.

10. The pulverizer according to claim 1, wherein the housing includes means defining a plurality of external corners and edges, and has further said air-inlet openings formed therein adjacent said corners and edges thereof.

11. A pulverizer comprising a pulverizing device driven by means of a motor and connected to an inlet chute and a collecting reservoir for respectively supplying feed material to and receiving pulverized material from said pulverizing device, the improvement wherein the pulverizing device is arranged in a housing having at least one air-inlet opening and an air outlet, wherein the air outlet is arranged at the bottom side of the housing and is connected to a vacuum source for drawing air in a first direction from said housing through said air outlet, wherein a filter is provided in the area of the air outlet for filtering pulverized material from the air as drawn through said air outlet, and wherein said housing includes means defining an outlet chamber which communicates with said air outlet, and means for loading the filter with compressed air directed oppositely of said first direction, including a water-jet pipe movably arranged on the housing and disposed in said outlet chamber.

12. The pulverizer according to claim 1, wherein said housing includes means for blowing compressed air against said filter in a direction which is substantially opposite said first direction.

* * * * *